US008190070B2

(12) United States Patent
Maeshima et al.

(10) Patent No.: US 8,190,070 B2
(45) Date of Patent: May 29, 2012

(54) TONER CARTRIDGE AND IMAGE FORMING APPARATUS INCLUDING THE TONER CARTRIDGE

(75) Inventors: Masanobu Maeshima, Osaka (JP); Takaya Akiyama, Osaka (JP)

(73) Assignee: Kyocera Mita Corporation (JP)

( * ) Notice: Subject to any disclaimer, the term of this patent is extended or adjusted under 35 U.S.C. 154(b) by 225 days.

(21) Appl. No.: 12/644,387

(22) Filed: Dec. 22, 2009

(65) Prior Publication Data

US 2010/0158575 A1 Jun. 24, 2010

(30) Foreign Application Priority Data

Dec. 24, 2008 (JP) ..... 2008-328740
Nov. 27, 2009 (JP) ..... 2009-269711

(51) Int. Cl.
*G03G 15/08* (2006.01)

(52) U.S. Cl. ..... 399/262; 399/263

(58) Field of Classification Search ..... 399/262, 399/263
See application file for complete search history.

(56) References Cited

U.S. PATENT DOCUMENTS

2004/0131391 A1 7/2004 Nagashiro
2007/0077101 A1 * 4/2007 Tamura et al. ..... 399/262

FOREIGN PATENT DOCUMENTS

JP 2004-205587 7/2004

* cited by examiner

*Primary Examiner* — David Gray
*Assistant Examiner* — Erika J Villaluna
(74) *Attorney, Agent, or Firm* — Gerald E. Hespos; Michael J. Porco

(57) ABSTRACT

A toner cartridge for containing toner is provided with a lever for operating the toner cartridge, and a cover partly surrounding the lever. The cover forms an uncovering area where the lever is not covered, and a user can access the lever through the uncovering area.

12 Claims, 11 Drawing Sheets

TONER CARTRIDGE AND IMAGE FORMING APPARATUS INCLUDING THE TONER CARTRIDGE

BACKGROUND OF THE INVENTION

1. Field of the Invention

The present invention relates to a toner cartridge configured to store toner and slidably and detachably mounted in an image forming apparatus as well as the image forming apparatus with the toner cartridge.

2. Description of the Related Art

A toner cartridge configured to replenish a developing device with toner is detachably mounted in an image forming apparatus such as a copier or a printer. The toner cartridge is, for example, slidably and detachably mounted at some position in a housing of the image forming apparatus. The slidable toner cartridge may be horizontally withdrawn from and pushed into the housing of the image forming apparatus. Generally, a grip is provided on a proximal wall of the slidable toner cartridge, so that a user may hold the grip to easily withdraw the toner cartridge from the housing.

The toner cartridge may include a shutter mechanism configured to prevent undesirable leakage of the toner to an outside before the toner cartridge is mounted in the image forming apparatus, after the toner cartridge is detached from the image forming apparatus or while the toner cartridge is replaced.

The toner cartridge may include a housing formed with a toner discharge opening, a shutter configured to open and close the toner discharge opening, a lever configured to operate the shutter and a locking member configured to lock the lever. The lever at a closing position elastically deforms an elastic part of the locking member to bias the locking member toward the closing position. After the housing of the toner cartridge is mounted in the housing of the image forming apparatus, the locking member unlocks the lever so that the lever can be rotated from the closing position to an opening position.

The lever may be exposed from the proximal wall of the toner cartridge, so that the user may easily access the lever. Such a lever includes a rotating structure, which is relatively weak against an external force. While the toner cartridge itself is transported for replacement, the lever exposed from the proximal wall is potentially subjected to collision with a floor surface or a side wall of a building or other equipment. As a result, the function of the lever itself or the rotating mechanism (e.g. shutter) connected with the lever may be damaged.

SUMMARY OF THE INVENTION

In view of the drawbacks in the prior arts, an object of the present invention is to provide a toner cartridge configured to protect a lever for operating the toner cartridge from external forces and an image forming apparatus incorporating the toner cartridge.

One aspect of the present invention is directed to a toner cartridge configured to contain toner, comprising a lever configured to operate the toner cartridge; and a cover partially surrounding the lever; wherein: the cover forms an uncovering area where the lever is not covered so that the lever is accessible through the uncovering area.

A toner cartridge according to another aspect is detachably mounted in an image forming apparatus. The toner cartridge comprises a housing configured to contain toner inside and including at least one side wall extending in a direction orthogonal to a sliding direction of the toner cartridge; a cover attached to the side wall of the housing; and a lever rotatably attached to the cover, wherein: the cover includes: a base plate rotatably holding the lever and engaged with the side wall, and a grip plate distanced from the base plate at a side opposite to the housing and arranged to face the base plate, a grip space is formed between the grip plate and the lever so that fingers can be inserted into the grip space from above.

Yet another aspect of the present invention is directed to an image forming apparatus configured to form a toner image on a sheet, comprising an image forming unit configured to form the toner image on the sheet; and a toner cartridge detachably mounted into the image forming unit for replenishing toner, wherein: the toner cartridge configured to contain toner includes a lever configured to operate the toner cartridge and a cover partially surrounding the lever, the cover forms an uncovering area where the lever is not covered so that the lever is accessible through the uncovering area.

These and other objects, features and advantages of the present invention will become more apparent upon a reading of the following detailed description. Further, advantages of the present invention will become more apparent in the following description with reference to accompanying drawings.

DETAILED DESCRIPTION OF THE PREFERRED EMBODIMENTS

Hereinafter, one embodiment of the present invention is described with reference to the drawings. Direction-indicating terms such as "front", "back", "up", "down", "left" and "right" in the following description are merely used for the purpose of clarifying the description and do not limit the present invention at all. "Front" and similar terms indicate a side toward a user operating an image forming apparatus unless otherwise described. "Back", "left", "right" and similar terms indicate directions based on the "front". The "leading edge of a sheet" and similar terms mean a leading edge of the sheet in a conveying direction thereof.

Figure 1:
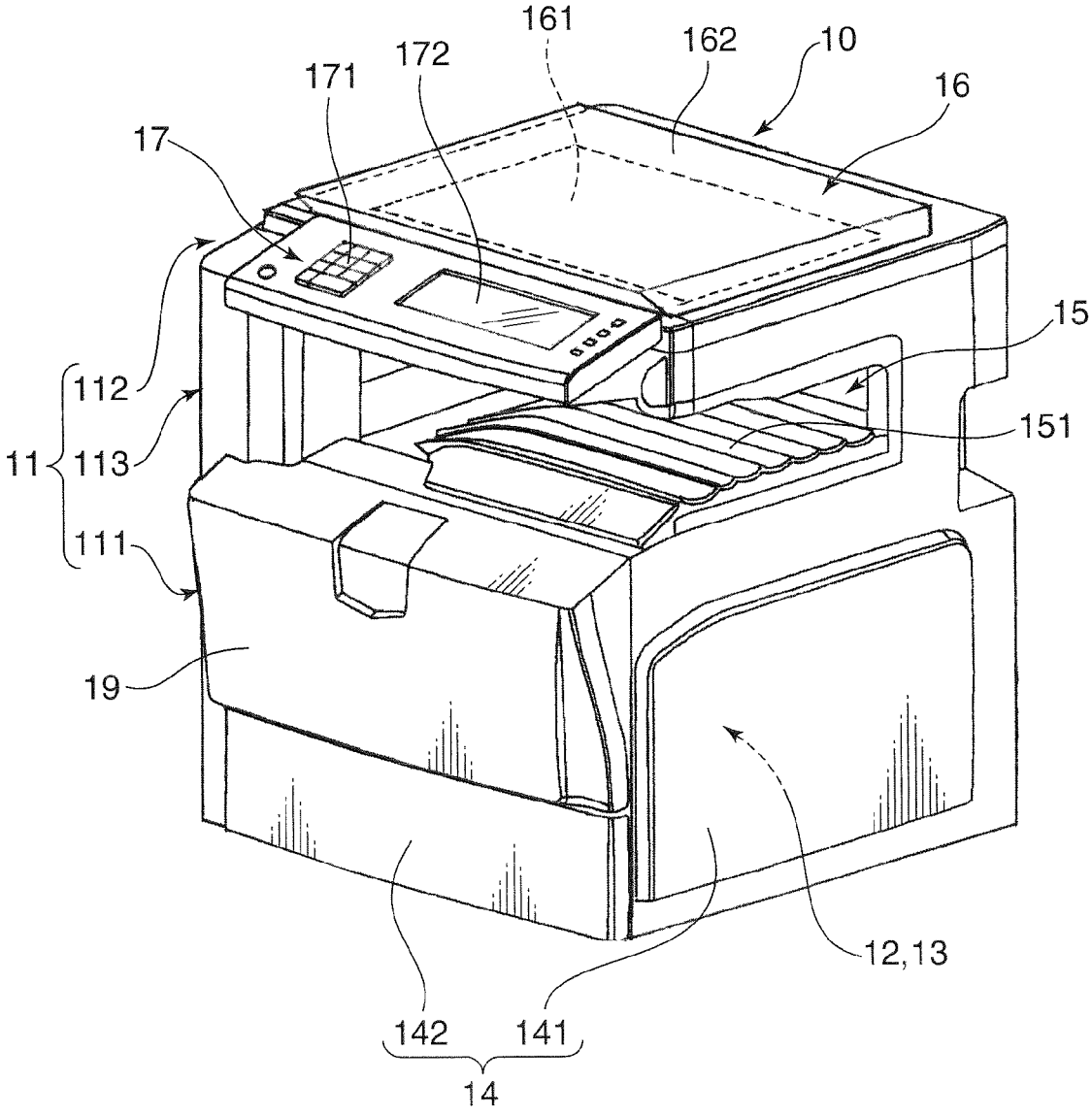
FIG. 1 is a perspective view of an image forming apparatus according to one embodiment of the invention.

FIG. 1 is a perspective view of an image forming apparatus according to one embodiment of the present invention. Although the image forming apparatus shown in FIGS. 1 and 2 is a copier so-called internal discharge type, the present invention is not limited thereto, and may be a printer, a facsimile machine, a multi-functional peripheral with these functions or an other apparatus configured to form a toner image on a sheet.

The image forming apparatus 10 includes a substantially rectangular parallelepipedic housing 11, an image forming unit 12 in the housing 11, a fixing unit 13 built in the housing 11, a storing unit 14 configured to store sheets in the housing 11, a discharge unit 15 disposed in a middle part of the housing 11, an image reading unit 16 and an operation unit 17 both of which are provided in an upper part of the housing 11. The housing 11 includes a substantially rectangular parallelepipedic lower housing 111 incorporating the image forming unit 12, the fixing unit 13 and the storing unit 14, a flat and substantially rectangular parallelepipedic upper housing 112 provided with the image reading unit 16 and the operation unit 17, and a connecting housing 113 disposed between the lower housing 111 and the upper housing 112. The connecting housing 113 extending along the left edge and the rear edge of the housing 11 looks a substantially L-shaped in a plan view. The upper surface of the lower housing 111, the lower surface of the upper housing 112 and the right surface of the connecting housing 113 form the inwardly recessed discharge section 15.

The operation unit 17 forming a front part of the upper housing 112 includes a numerical keypad 171, a LCD touch panel 172 and operation keys. The operation unit 17 is configured for a user to enter information on an image forming process. For example, the user may enter using the numerical keypad 171 how many sheets the user has to print or may enter print density or the like using the touch panel 172.

Figure 2:
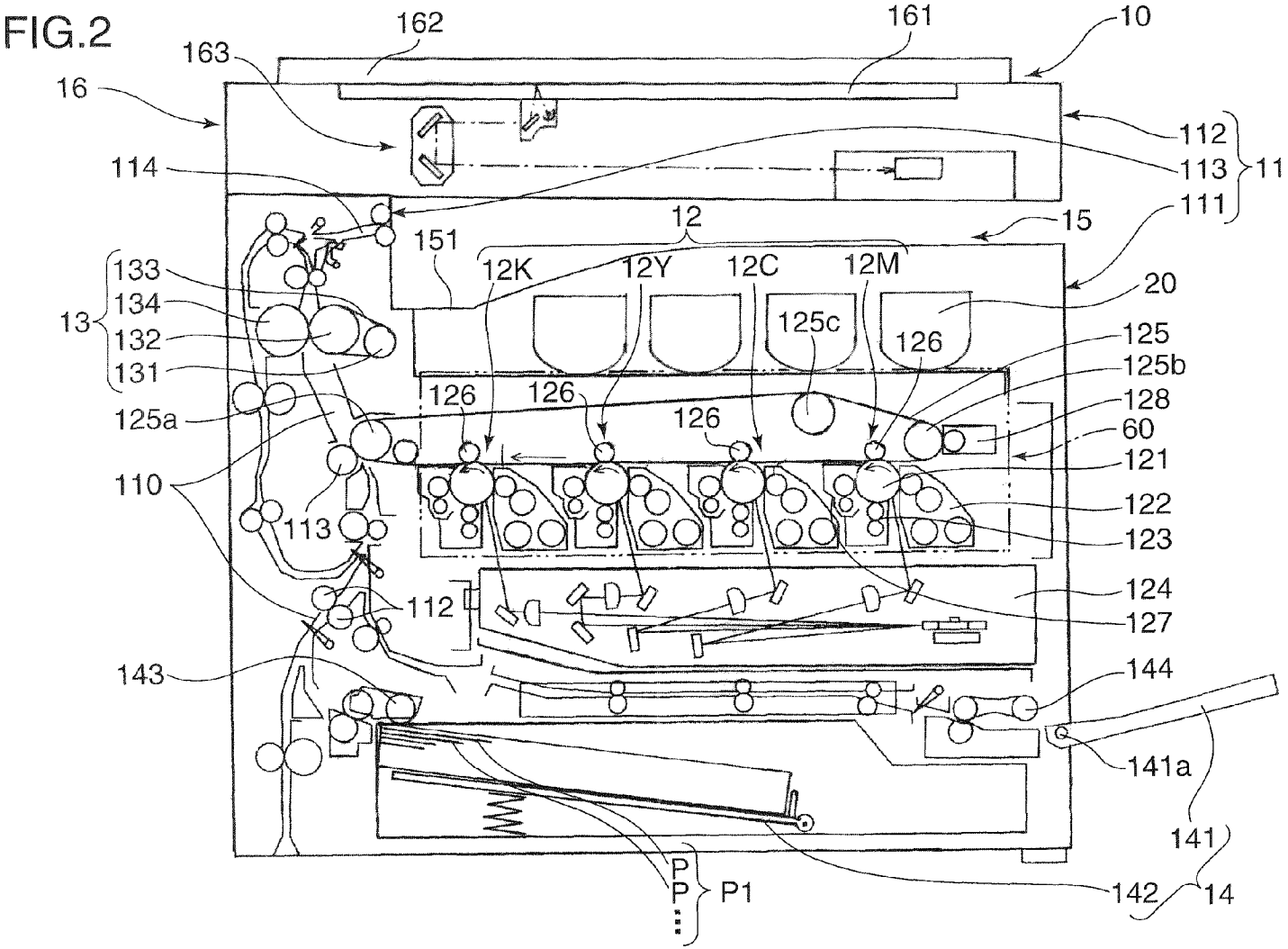
FIG. 2 is a sectional view showing the internal configuration of the image forming apparatus shown in FIG. 1.

FIG. 2 schematically shows an internal configuration of the image forming apparatus 10 shown in FIG. 1. The image forming apparatus is further described with reference to FIG. 1 as well as FIG. 2.

The user may operate the image forming apparatus 10 to read a desired document image using the image reading unit 16 including a contact glass 161 mounted in the upper surface of the upper housing 112 and a pressing cover 162 rotatable over the contact glass 161. The user may place the desired document on the contact glass 161 after rotating the pressing cover 162 upward, and then the user may rotate the pressing cover 162 downward to press the document on the contact glass 161. A scanning mechanism 163 is disposed in the upper housing 111. If the user, for example, operate the image forming apparatus 10 using the operation unit 17, the scanning mechanism 163 scans and reads an image of the document on the contact glass 161. Analog information of the image read by the scanning mechanism 163 is converted into a digital signal. The image forming apparatus 10 forms an image on a sheet P based on the digital signal. the image forming apparatus 10 makes an image on a sheet P based on the digital signal.

The sheet P is supplied from the storing unit 14 including a sheet cassette 142 detachably inserted into the lower housing 111 and a manual feed tray 141 rotatably attached to the right surface of the lower housing 111. The sheet cassette 142 is a substantially parallelepipedic box which is upwardly opened. A sheet stack P1 including a plurality of the stacked sheets P one over another is stored in the sheet cassette 142. A pickup roller 143 is disposed above the left edge of the sheet cassette 142. The left edge (leading edge) of the sheet stack P1 in the sheet cassette 142 is pushed up to be held in contact with the pickup roller 143, which feeds the sheets P one by one from the sheet stack P1 to a conveyance path 110. Conveyor roller pairs disposed at intermediate positions of the conveyance path 110 feed the sheet P to a secondary transfer nip formed between a second transfer roller 113 to be described later and an intermediate transfer belt 125 to be described later. Although one sheet cassette 142 is used in this embodiment, the present invention is not limited thereto and two or more sheet cassettes 142 arranged one above another may be used as the storing unit 14.

A supporting shaft 141*a* are formed at a lower edge portion of the manual feed tray 14 attached to the right surface of the lower housing 111, so that the manual feed tray 14 is rotatable about the supporting shaft 141*a* between a closing position where the manual feed tray 14 is substantially parallel with the left surface of the lower housing 111 to close a sheet feed opening and an opening position where the manual feed tray 14 projects rightward. The manual feed tray 14 at the opening position may support a sheet P to be fed by a feed roller 144 and the like to the secondary transfer nip formed between the second transfer roller 113 (described later) and the intermediate transfer belt 125 (described later) built in the lower housing 111.

A vertically rotatable maintenance door 19 is attached to be rotated upward or downward to the front wall of the lower housing 111. The user may open the maintenance door 19 to remove the sheet P fed from the storing unit 14 if the sheet P is jammed in the lower housing 111.

The image forming unit 12 forms a toner image on a sheet P fed from the storing unit 14. A magenta unit 12M configured to form a toner image with magenta toner, a cyan unit 12C configured to form a toner image with cyan toner, a yellow unit 12Y configured to form a toner image with yellow toner and a black unit 12K configured to form a toner image with black toner are disposed above the sheet cassette 142 in the lower housing 111. The magenta unit 12M, the cyan unit 12C, the yellow unit 12Y and the black unit 12K are successively arranged from the right side toward the left side.

Each of the units 12M, 12C, 12Y and 12K includes a photoconductive drum 121 and a developing device 122 configured to supply toner to the photoconductive drum 121. After an electrostatic latent image is formed on a circumferential surface of the photoconductive drum 121, the toner is supplied from the developing device 122 to form a toner image (visible image) corresponding to the electrostatic latent image.

The photoconductive drums 121 in FIG. 2 rotate counterclockwise. Toner images formed on the photoconductive drums 121 are transferred to the intermediate transfer belt 125 moving above the photoconductive drums 121.

In the lower housing 111, four toner cartridges 20 respectively containing magenta toner, cyan toner, yellow toner and black toner are detachably mounted between the intermediate transfer belt 125 and the discharge section 15. Toner replenishment ducts (not shown) extend from the respective toner cartridges 20 to the corresponding units 12M, 12C, 12Y and the 12K to replenish toner to the respective units 12M, 12C, 12Y and 12K.

The image forming unit 12 includes chargers 123 below the photoconductive drums 121 of the respective units 12M, 12C, 12Y and 12K and an exposure device 124 below the respective chargers 123. Each charger 123 uniformly charges the circumferential surface of the corresponding photoconductive drum 121. The exposure device 124 irradiates the charged circumferential surfaces of the photoconductive drums 121 with laser beams based on the digital signal corresponding to the read document. As a result, electrostatic latent images corresponding to respective color components of the document are formed on the circumferential surfaces of the photoconductive drums 121 of the respective units 12M, 12C, 12Y and 12K. Thereafter, the developing devices 122 supply the toner to the circumferential surfaces of the photoconductive drums 121, so that the toner is electrostatically attached to the electrostatic latent images to form toner images.

The intermediate transfer belt 125 above the respective photoconductive drums 121 extends between a left drive roller 125*a* and a right driven roller 125*b*. A lower surface in a lower part of the intermediate transfer belt 125 (moving leftward) is held in contact with the circumferential surfaces of the respective photoconductive drums 121. An outer circumferential surface of the intermediate transfer belt 125 is configured to bear the toner. Primary transfer rollers 126 are arranged above the respective photoconductive drums 121. The intermediate transfer belt 125 turning between the drive roller 125*a* and the driven roller 125*b* is pressed against the circumferential surfaces of the photoconductive drums 121 by the primary transfer rollers 126. A tension roller 125*c* between the drive roller 125*a* and the driven roller 125*b* is biased upwardly, for example, by a biasing member (not shown) so that the tension roller 125*c* near the driven roller 125*b* forms the intermediate transfer belt 125 into an upward projecting contour like a mountain so as to produce a tensile force in the intermediate transfer belt 125.

The photoconductive drum 121 of the magenta unit 12M transfers the magenta toner image to the intermediate transfer belt 125 while the intermediate transfer belt 125 is turned. Then, the cyan unit 12C transfers the cyan toner image onto the magenta toner image. Further the yellow unit 12Y transfers the yellow toner image onto the superimposed toner image of the magenta toner and the cyan toner. Finally, the black unit 12K transfers the black toner image onto the superimposed toner image of the magenta toner, the cyan toner and the yellow toner, thereby completing a full color toner image. The full color toner image completed on the intermediate transfer belt 125 is transferred to the sheet P conveyed from the storing unit 14.

The conveyance path 110 vertically extending in the left part of the image forming unit 12 includes a conveyor roller pair 112. The sheet P conveyed from the storing unit 14 is conveyed by the conveyor roller pair 112 and guided by the conveyance path 110 to move for the secondary transfer nip formed between the second transfer roller 113 to be described later and the intermediate transfer belt 125 to be described later. The conveyance path 110 includes the second transfer roller 113. The second transfer roller 113 facing the drive roller 125*a* on which the intermediate transfer belt 125 is wound is held in contact with the outer circumferential surface of the intermediate transfer belt 125 to form the secondary transfer nip. The sheet P guided by the conveyance path 110 to the second transfer nip between the intermediate transfer belt 125 and the second transfer roller 113 is pressed and held between them, so that the full color toner image completed on the intermediate transfer belt 125 is transferred to the sheet P.

The image forming apparatus 10 further includes a cleaning device 128 configured to clean the intermediate transfer belt 125 by removing the toner remaining on the intermediate transfer belt 125 after the transfer (generally called as secondary transfer) of the toner image to the sheet P. The cleaning device 128 is arranged to face the driven roller 125*b*.

The fixing unit 13 applying a fixing process to the toner image transferred onto the sheet P by the image forming unit 12 includes a heating roller 131, a fixing roller 132 arranged to face the heating roller 131, a fixing belt 133 extending between the heating roller 131 and the fixing roller 132 and a pressure roller 134 arranged to face the fixing roller 132. The heating roller 131 includes a built-in electric heating element used as a heating source.

The sheet P bearing the toner image is conveyed to the fixing unit 13. While the sheet P is passing between the pressure roller 134 and the fixing belt 133 at a high temperature, the toner image is subjected to heat from the fixing belt 133 to fix the toner image to the sheet P.

Color printing is finished upon the completion of the fixing process by the fixing unit 13. The color printed sheet P is guided to a conveyance path 114 extending upward from the fixing unit 13 and discharged to the discharge section 15 through the right surface of the connecting housing 113. The upper surface of the lower housing 111 is used as a discharge tray 151 configured to support the color printed sheet P.

Figure 3:
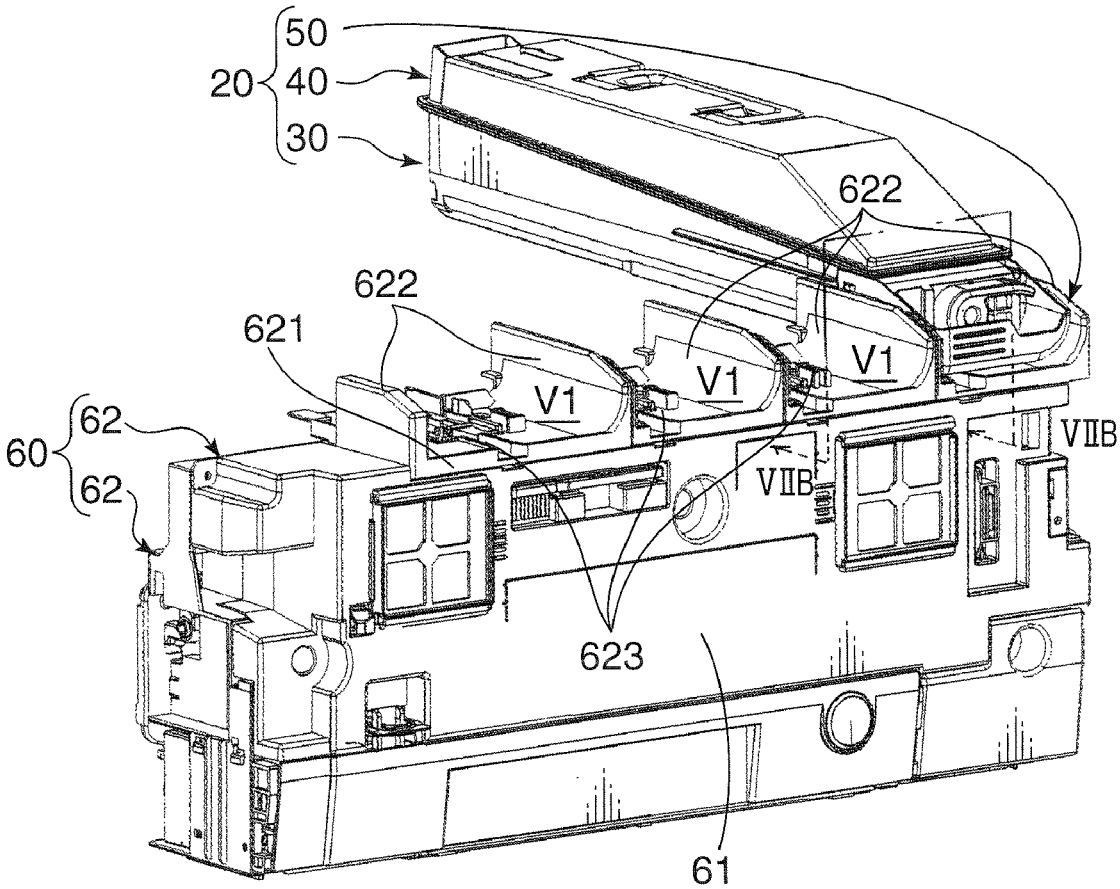
FIG. 3 is a perspective view showing a toner cartridge attached to an intermediary device of the image forming apparatus shown in FIG. 1.

FIG. 3 is a perspective view showing an intermediary device 60 represented by chain double-dashed line in FIG. 2. The arrangement of the intermediary device 60 is described with reference to FIG. 2 as well as FIG. 3.

The intermediary device 60 arranged along the front wall of the lower housing 111 is configured to support the front ends of the respective toner cartridges 20 with the top surface of the intermediary device 60. The constituent elements of the image forming apparatus (such as photoconductive drums 121, intermediate transfer belt 125, developing devices 122 and chargers 123) are arranged behind the intermediary device 60. The intermediary device 60 guides the toner supplied from the toner cartridges 20 toward the respective developing devices 122 below the intermediate transfer belt 125.

The intermediary device 60 also functions to store waste toner yielded after the transfer process. Cleaning devices 127 disposed to the left of the respective photoconductive drums 121 remove the toner remaining on the circumferential surfaces of the photoconductive drums 121 after the transfers (called as "primary transfers") of the toner images to the intermediate transfer belt 125, and then the removed toner is stored as the waste toner in the intermediary device 60. The circumferential surfaces of the photoconductive drums 121 cleaned by the cleaning devices 127 go for the chargers 123 to be charged anew. The cleaning device 128 facing the driven roller 125*b* at the right side of the intermediate transfer belt 125 removes the toner remaining on the outer circumferential surface of the intermediate transfer belt 125 after the transfer (called "secondary transfer") of the toner image to the sheet P, and then the removed toner is stored as the waste toner in the intermediary device 60. Thereafter, new toner images are transferred from the respective photoconductive drums 121 to the outer circumferential surface of the intermediate transfer belt 125 cleaned by the cleaning device 128.

Figures 4A, 4B:
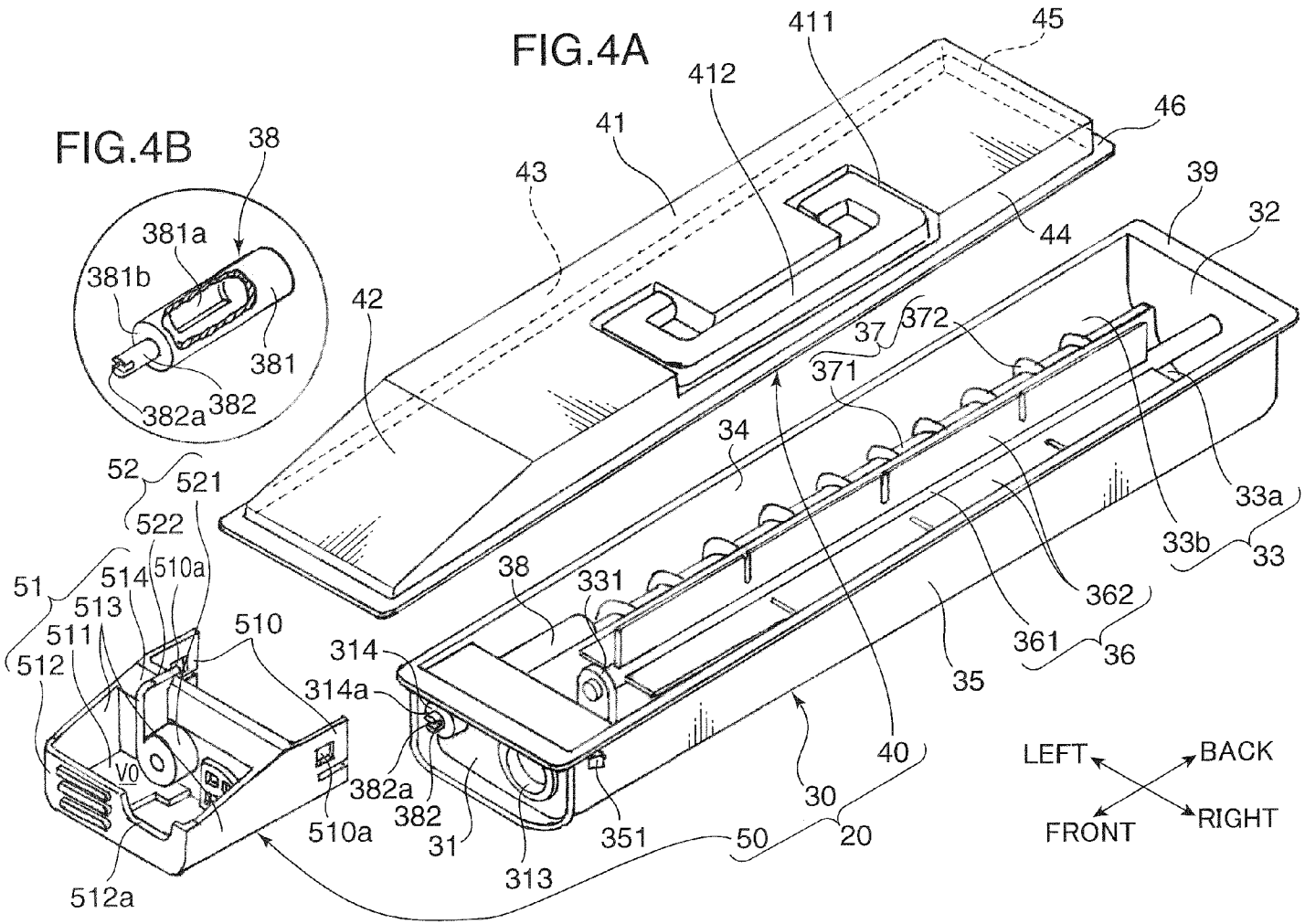
FIG. 4A is an exploded perspective view of the toner cartridge shown in FIG. 3.
FIG. 4B is a perspective view of a tubular shutter shown in FIG. 4A.
Figure 5:
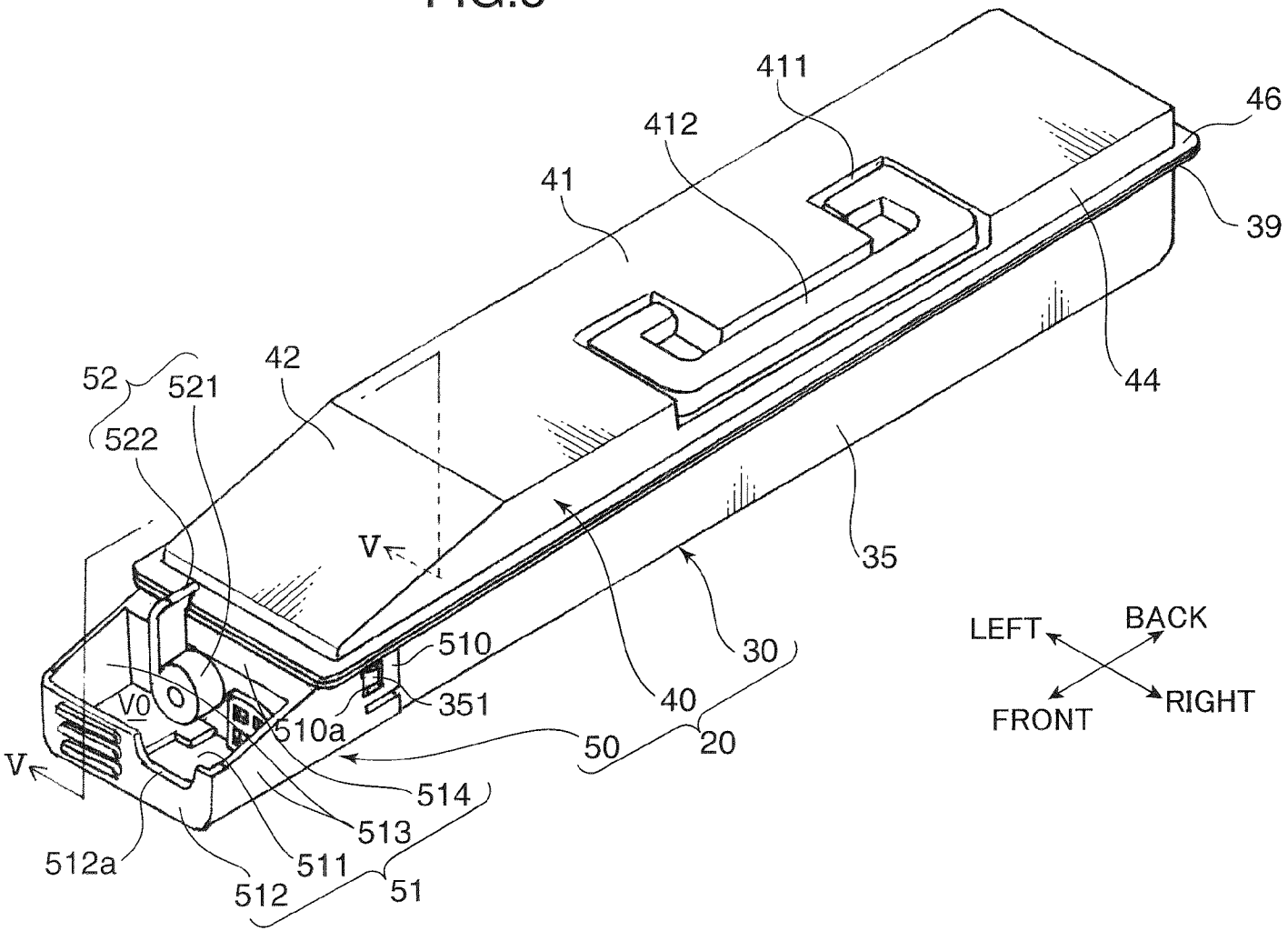
FIG. 5 is an perspective view of the assembled toner cartridge shown in FIG. 4A.

FIG. 4A is an exploded perspective view of the toner cartridge 20 shown in FIG. 3. FIG. 5 is a perspective view of the assembled toner cartridge shown in FIG. 4A. The toner cartridge 20 is described with reference to FIGS. 1 and 3 as well as FIGS. 4A and 5.

The toner cartridge 20 includes a housing 30, of which upper side includes an opening, configured to contain the toner, a lid 40 configured to close the opening of the housing 30, and an attachment 50 to be attached to a front end of the housing 30. The housing 30 and the lid 40 extend from a front end of the toner cartridge 20 supported by the intermediary device 60 toward the rear surface of the image forming apparatus 10 (while the toner cartridge 20 is attached to the intermediary device 60). The toner cartridge 20 is slidably inserted to and withdrawn from a front of the lower housing 111.

The housing 30 includes a front plate 31 configured to extend orthogonal to a sliding direction of the toner cartridge 20, a rear plate 32 arranged to face the front plate 31, a bottom plate 33 extending between the lower edges of the front plate 31 and the rear plate 32, a left plate 34 extending upward from the left edge of the bottom plate 33 and a right plate 35 extending upward from the right edge of the bottom plate 33.

The bottom plate 33 includes a right bottom plate 33*a* and a left bottom plate 33*b*. The cross-sections of the right and left bottom plates 33*a*, 33*b* are arched. The radius of the arched cross section of the right bottom plate 33*a* is larger than that of the arched cross section of the left bottom plate 33*b*. A partition plate 331 extending along a boundary between the right bottom plate 33*a* and the left bottom plate 33*b* is arranged in the housing 30 so that the partition plate 331 partially partitions an internal space of the housing 30 into left and right parts.

The front plate 31 is formed with a filling opening through which the toner is introduced into the housing 30. After the toner is filled into the toner cartridge 20, the filling opening is plugged with a cap 313.

The lid 40 includes a flat top plate 41, a front plate 42 inclined down toward the front side from the front edge of the top plate 41, a left plate 43 extending downward from the left edge of the top plate 41, a right plate 44 extending downward from the right edge of the top plate 41 and a rear plate 45 extending downward from the rear edge of the top plate 41. The top plate 41, the front plate 42, the left plate 43, the right plate 44 and the rear plate 45 are integrally molded with resin.

A substantially C-shaped recess 411 in a plan view is formed in an upper surface of the lid 40. A grip 412 complementary to the recess 411 is arranged in the recess 411. The grip 412 is attached to the lid 40 so as to be rotated vertically. An outward extending upper flange 46 surrounds the entire lower edge of the lid 40. An outward extending lower flange 39 surrounds the entire upper edge of the housing 30. The upper and lower flanges 46, 39 may be identically shaped so that they are placed one over the other. The upper flange 46 is placed on the lower flange 39, and the lower flange 39 and the upper flange 46 may be subjected to a welding process (e.g. using a high-frequency wave) to close the housing 30 with the lid 40.

An agitator 36 is arranged in the housing 30. The agitator 36 configured to agitate the toner in the housing 30 includes an agitating shaft 361 extending from the rear plate 32 toward the front plate 31 and a plurality of film-made agitating fins 362 extending in radial directions of the agitating shaft 361 from the circumferential surface of the agitating shaft 361. Although the agitator 36 shown in FIG. 4A includes four agitating fins 362 arranged at intervals of 90°, the present invention is not limited thereto, and the agitator 36 may include a single agitating shaft 362 and two, three or five or more agitating fins.

The agitating shaft 361 extends along a center of curvature of the right base plate 33*a*. A distance from a rotation center of the agitating shaft 361 to the distal edges of the agitating fins 362 is longer than the radius of the curvature of the right base plate 33*a*, so that the distal edges of the agitating fins 362 slide on the upper surface of the right base plate 33*a* with agitating the entire toner during rotation of the agitating shaft 361.

A screw feeder 37 extending from the rear plate 32 toward the front plate 31 and a tubular shutter 38 surrounding the front end of the screw feeder 37 are arranged in the housing 30.

Figure 6:
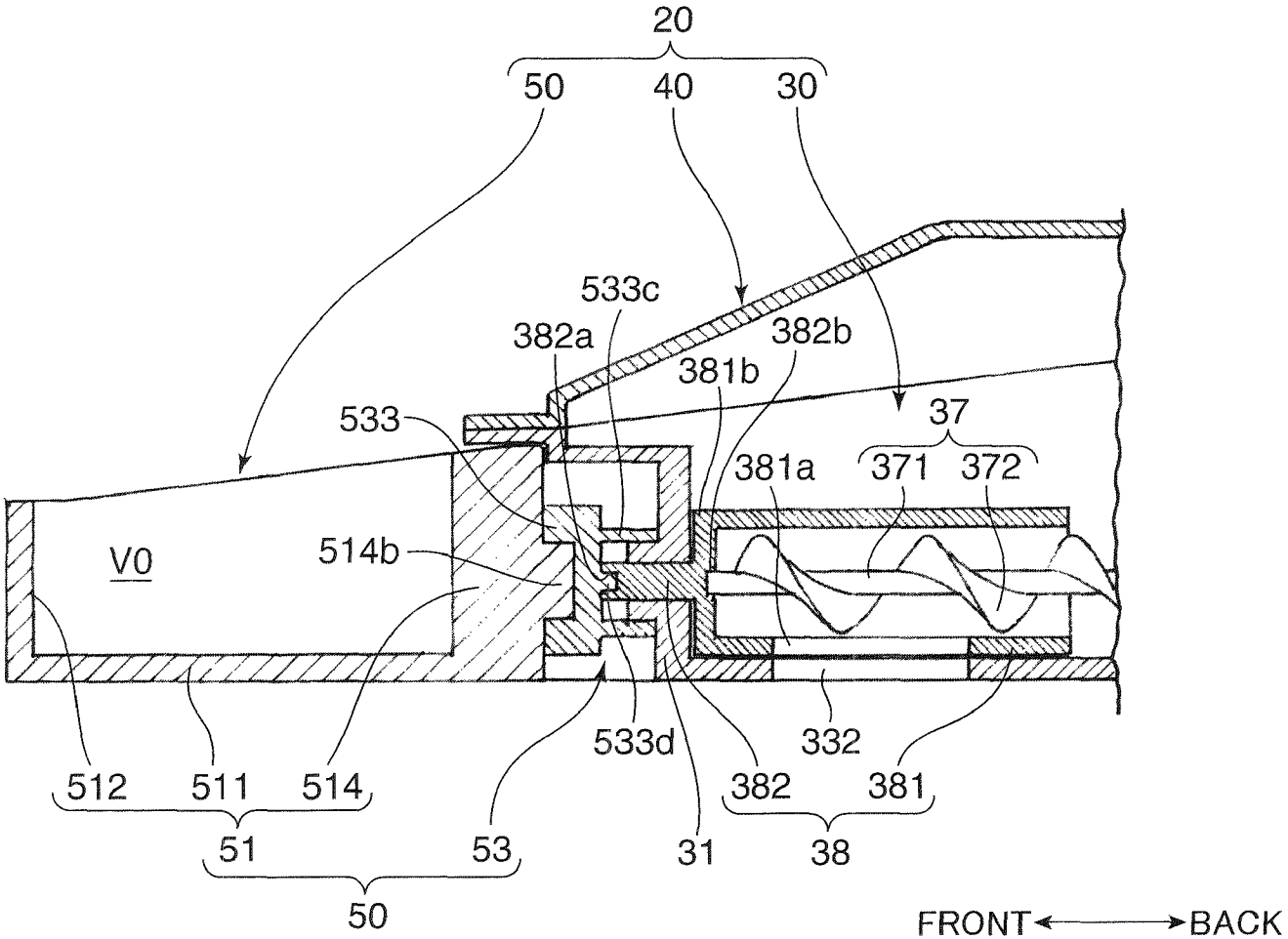
FIG. 6 is a sectional view of the toner cartridge shown in FIG. 4A.

FIG. 4B shows the tubular shutter 38 partially cut away. FIG. 6 is a sectional view along V-V of FIG. 5. The toner cartridge 20 is further described with reference to FIGS. 4A and 5 as well as FIGS. 4B and 6.

The screw feeder 37 includes a feeder shaft 371 arranged above the left base plate 33*b* and extending from the rear plate 32 toward the front plate 31, and a spiral fin 372 concentrically and spirally surrounding the feeder shaft 371. A rotary axis of the feeder shaft 371 coincides with the center of the curvature of the left base plate 33*b*. The outer diameter of the spiral fin 372 is slightly smaller than the radius of the curvature of the left base plate 33*b*. A toner replenishment opening 332 is formed near the front end of the left base plate 33*b*. The spiral fin 372 is configured to rotate together with the feeder shaft 371 with conveying the toner to the toner replenishment opening 332.

A gear mechanism (not shown) coupling the agitating shaft 361 to the feeder shaft 371 is formed on the outer surface of the rear plate 32. The gear mechanism rotates the agitating shaft 361 in conjunction with the feeder shaft 371. A drive motor (not shown) is connected with the gear mechanism. The agitating shaft 361 and the feeder shaft 371 simultaneously rotate about their axes by a transmission of a driving force from the drive motor.

The tubular shutter 38 includes a tube 381 and a shaft 382 projecting forward from the front end surface of the tube 381. The outer diameter of the tube 381 is slightly smaller than the radius of the curvature of the left base plate 33*b* and slightly larger than the outer diameter of the spiral fin 372. The shaft 382 is concentric with the tube 381. An opening 381*a* formed in a circumferential wall of the tube 381 is configured to communicate with the toner replenishment opening 332.

The toner enters the tubular shutter 38 through an opening at a rear end of the tubular shutter 38 while the screw feeder 37 rotates. A front wall 381*b* closing the front end of the tube 381 prevents the toner from moving forward beyond the tubular shutter 38. The shaft 382 projects forward from the center of the front wall 381*b*. A key groove 382*a* is formed at the distal end of the shaft 382. The shaft 382 is engaged with a second sect gear 533 via the key groove 382*a*. A supporting hole 382*b* is formed in the inner surface of the front wall 381*b* of the tube 381. The front end of the feeder shaft 371 is inserted to and rotatably supported in the supporting hole 382*b*. Accordingly, the rotation of the feeder shaft 371 is not transmitted to the tubular shutter 38. The tubular shutter 38 rotates in conjunction with the second sect gear 533.

An annular positioning portion 314 projecting forward is formed on the outer surface of the front plate 31. The positioning portion 314 is formed concentrically with the feeder shaft 371. A through hole 314*a* is formed along an axis of the positioning portion 314. A key projection 533*d* of the second sect gear 533 to be described later is inserted to and rotatably supported in the through hole 314*a*.

Figure 7A:
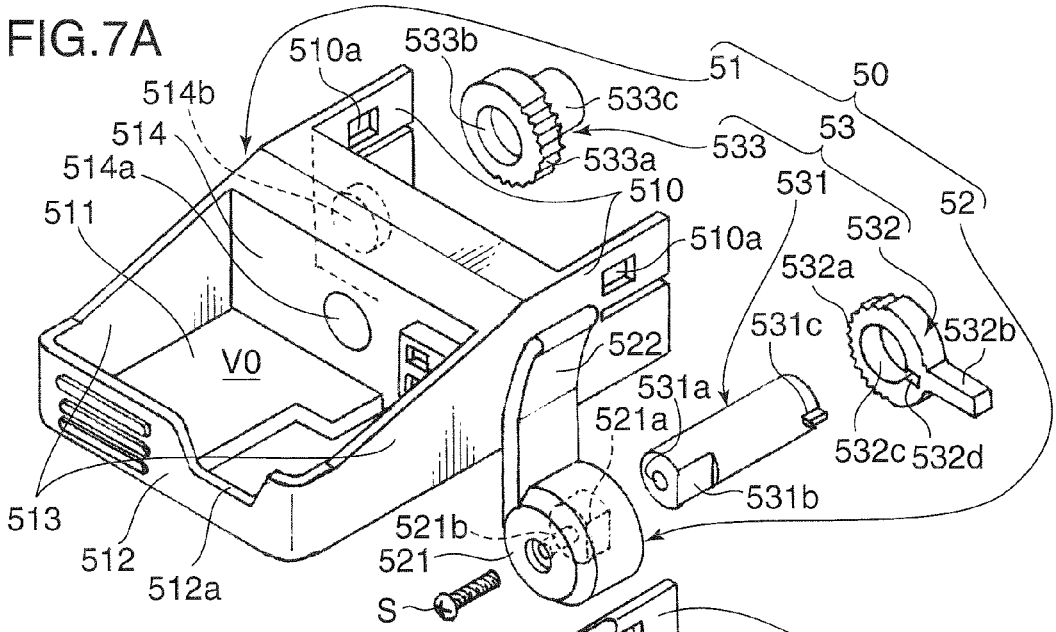
FIG. 7A is an exploded perspective view showing an attachment of the toner cartridge described in FIG. 4A.
Figure 7B:
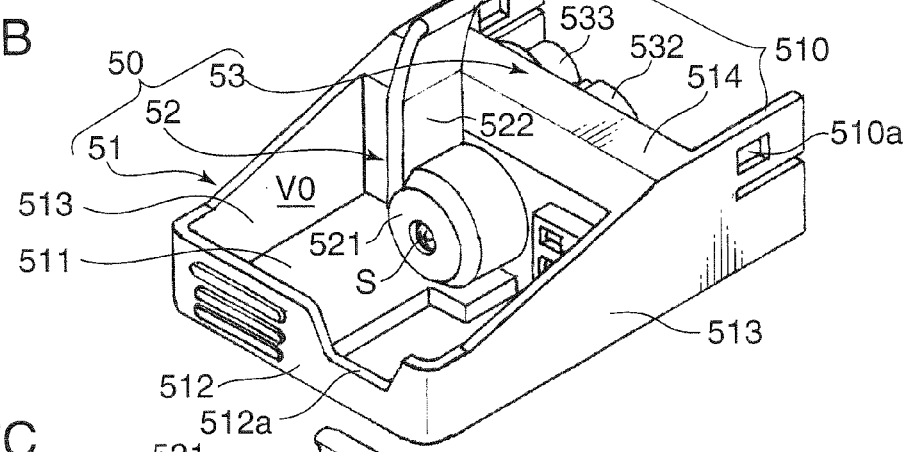
FIG. 7B is an perspective view of the assembled attachment shown in FIG. 7A when viewed from front.
Figure 7C:
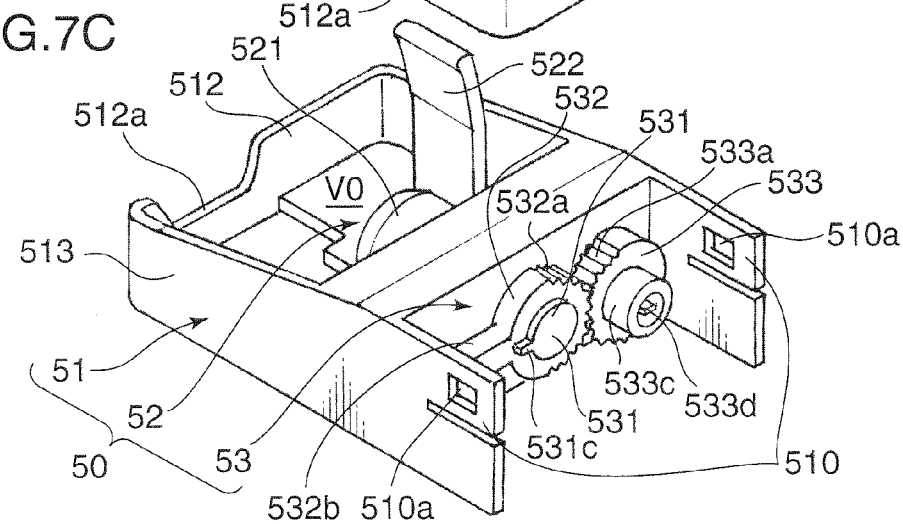
FIG. 7C is an perspective view of the assembled attachment shown in FIG. 7A when viewed from behind.

FIG. 7A is an exploded perspective view of the attachment 50. FIG. 7B is an perspective view showing the external configuration of the assembled attachment 50. FIG. 7C is an perspective view showing the internal configuration of the assembled attachment 50. The attachment 50 is described with reference to FIGS. 4A and 6 as well as FIGS. 7A to 7C.

The attachment 50 attached to the front end of the housing 30 is used to mount the toner cartridge 20 into the housing 11 of the image forming apparatus 10 as well as open and close the tubular shutter 38.

The attachment 50 includes a cover 51 configured to cover the front end of the housing 30. The cover 51 is used as a grip for the user to mount or withdraw the toner cartridge 20 into/from the housing 11 of the image forming apparatus 10. The attachment 50 further includes a lever 52 used to open/close the tubular shutter 38 and fix the toner cartridge 20 to the intermediary device 60, and a rotating mechanism 53 configured to transmit the rotation of the lever 52 to the tubular shutter 38.

The cover 51 partially surrounding the lever 52 includes a base plate 514 arranged between the lever 52 and the housing 30 so that the base plate 514 rotatably supports the lever 52, a grip plate 512 arranged in front of the base plate 514 so that it faces the base plate 514, and a bottom plate 511 extending between the lower edges of the base plate 514 and the grip plate 512. The cover 51 further includes a pair of side plates 513 extending between the left edges of the base plate 514 and the grip plate 512 and between the right edges of the base plate 514 and the grip plate 512, respectively. An area surrounded with the upper edges of the base plate 514, the grip plate 512 and the side plates 513 is an uncovering area where the lever 52 is not covered, so that the user may access the lever 52 through the uncovering area. The user inserting his or her fingers into a grip space V0 surrounded with the base plate 514, the bottom plate 511, the grip plate 512 and the side plates 513 may take hold of the toner cartridge 20 and operate the lever 52. The base plate 514, the bottom plate 511, the grip plate 512 and the side plates 513 function to prevent the user's fingers inserted into the grip space V0 from touching other devices around the toner cartridge 20 while protect the user's fingers inserted into the grip space V0. The bottom plate 511 closes an area surrounded with the lower edges of the base plate 514, the grip plate 512 and the side plates 513. Accordingly, the lever 52 is surrounded except one side so that the lever 52 is appropriately protected from external forces.

The cover 51 further includes a pair of holding plates 510 respectively extending backward from the left and right edges of the base plate 514. The holding plates 510 are used to attach the attachment 50 to the housing 30. The holding plates 510 tightly hold the front end of the housing 30 therebetween, so that the cover 51 is attached to the housing 30. Each holding plate 510 includes a rectangular hole 510*a*. Projections 351 outwardly projecting are formed on the front ends of the left and right plates 34, 35 of the housing 30. While the attachment 30 is attached to the housing 30, the pair of holding plates 510 are elastically deformed outwardly by the projections 351, and then the projections 351 are fitted into the rectangular holes 510*a*, so that the attachment 50 is attached to the front end of the housing 30.

A trapezoidal notch 512*a* formed in the upper edge of the grip plate 512 takes up a substantially right half section of the upper edge of the grip plate 512 so as to enlarge the uncovering area surrounded with the upper edges of the base plate 514, the grip plate 512 and the side plates 513. The user may operate the lever 52 by inserting her or his right hand fingers into the grip space V0 through the notch 512*a*. Thus, the notch 512*a* may enhance operability of the lever 52. The notch 512*a* may be formed to take up a substantially left half section of the upper edge of the grip plate 512 for left-handed users.

A mount hole 514*a* into which a rotary shaft 531 is inserted is formed in the center of the base plate 514. The lever 52 is mounted on the front end of the rotary shaft 531. A cylindrical projection 514*b* projecting backward is formed in a left area of the inner surface of the base plate 514. The second sect gear 533 is mounted on the projection 514*b*.

The lever 52 mounted on the base plate 514 via the rotary shaft 531 is arranged in the grip space V0. The lever 52 includes a cylindrical portion 521 and a lever plate 522 extending in a tangential direction from the outer circumferential surface of the cylindrical portion 521. Although the lever plate 522 extends upward from the left end of the cylindrical portion 521 to allow the lever 52 to be easily rotated clockwise in a shown example, the lever plate 522 may extend upward from the right end of the cylindrical portion 521 in the case of operating the lever 52 in a counterclockwise direction. A D-cut portion 531*b* is provided at the front end of the rotary shaft 531. A D-hole 521*a* complementary to the D-cut portion 531*b* of the rotary shaft 531 is formed in the rear surface of the cylindrical portion 521 of the lever 52. The D-hole 521*a* is formed concentrically with the cylindrical portion 521 which includes a through hole 521*b* with a smaller diameter than that of the D-hole 521*a*. The through hole 521*b* is concentrically formed with the cylindrical portion 521. An internally screw hole 531*a* is formed in the front end surface of the rotary shaft 531. The lever 52 may be coupled to the rotary shaft 531 by inserting the D-cut portion 531*b* of the rotary shaft 531 into the D-hole 521*a* of the cylindrical portion 521 and engaging a screw S with the internally screw hole 531*a* of the rotary shaft 531 inserted into the D-hole 521*a* via the through hole 521*b*.

The lever 52 is rotatable between a first position where the lever plate 522 vertically extends and a second position where the lever plate 522 horizontally extends. The bottom plate 511 extends along the lever plate 522 at the second position to prevent the rotation of the lever plate 522 beyond the bottom plate 511. The side plate 513 at the left side extends along the lever plate 522 at the first position to prevent the rotation of the lever plate 522 beyond the side plate 513. While the lever 52 is at the second position, the aperture 381*a* of the tubular shutter 38 communicates with the toner replenishment opening 332 of the housing 30 and the toner cartridge 20 is locked into the housing 11 of the image forming apparatus 10. On the other hand, when the lever 52 is at the first position, the aperture 381*a* of the tubular shutter 38 does not communicate with the toner replenishment opening 332 and the toner cartridge 20 is unlocked from the housing 11 of the image forming apparatus 10.

The rotating mechanism 53 formed between the base plate 514 and the housing 30 includes the rotary shaft 531 having a front end portion to be fitted with the cylindrical portion 521 of the lever 52, a first sect gear 532 fitted on a rear end portion of the rotary shaft 531, and the second sect gear 533 engaged with the first sect gear 532. The rotary shaft 531 is rotatably fitted into the mount hole 514*a* of the base plate 514. The second sect gear 533 is rotatably mounted on the projection 514*b* of the base plate 514. The base plate 514 partitions the lever 52 from the rotating mechanism 53.

The rotary shaft 531 may be slightly longer than the thickness of the base plate 514 so that the front and rear ends thereof respectively slightly project from the outer and inner surfaces of the base plate 514.

As described above, the screw S couples the cylindrical portion 521 of the lever 52 to the rotary shaft 531. Accordingly, when the user rotates the lever 52, the rotary shaft 531 integrally rotates with the lever 52. A key piece 531*c* projects outwardly from the circumferential surface of the rear end of the rotary shaft 531. When the rotary shaft 531 inserted into the mount hole 514*a* of the base plate 514, the key piece 531*c* gets caught by the inner surface of the base plate 514 to stop a forward movement of the rotary shaft 531, so that the rotary shaft 531 is positioned with respect to the base plate 541.

Gear teeth 532*a* are formed on substantially half the outer circumferential surface of the annular first sect gear 532. A prismatic stopper 532*b* is formed on the other half of the outer circumferential surface of the first sect gear 532. While the lever 52 is at the first position, the gear teeth 532*a* are located on the left side of the outer circumferential surface of the first sect gear 532 and the stopper 532*b* projects rightward from the outer circumferential surface of the first sect gear 532. The diameter of a center hole 532*c* formed in the center of the first sect gear 532 is slightly larger than the outer diameter of the rotary shaft 531. A key groove 532*d* extending in a radial direction is formed in the inner circumferential surface of the first sect gear 532. The key groove 532*d* is complementary to the key piece 531*c* of the rotary shaft 531, which is inserted into the center hole 532*c* of the first sect gear 532 so that the key piece 531*c* is engaged with the key groove 532*d*. The first sect gear 532 may integrally and concentrically rotate with the rotary shaft 531.

Gear teeth 533*a* are formed on half the outer circumferential surface of the second sect gear 533. While the lever 52 is at the first position, the gear teeth 533*a* located on the right side of the outer circumferential surface of the second sect gear 533 is engaged with the gear teeth 532*a* of the first sect gear 532. A recess 533*b* complementary to the projection 514*b* of the base plate 514 is formed in the front end surface of the second sect gear 533. The recess 533*b* of the second sect gear 533 is inserted into the projection 514*b*, so that the second sect gear 533 is rotatably supported.

A coupling tube 533*c* projects backward from the rear end surface of the second sect gear 533. The inner diameter of the coupling tube 533*c* is slightly larger than the outer diameter of the positioning portion 314 of the front plate 31. When the cover 51 is attached to the front end of the housing 30, the coupling tube 533*c* is attached to the positioning portion 314 to position the second sect gear 533.

The key projection 533*d* projecting backward from the rear end surface of the second sect gear 533 is engaged with the key groove 382*a* formed in the distal end of the shaft 382 of the tubular shutter 38 inserted into the coupling tube 533*c*. Thus, the rotation of the second sect gear 533 is transmitted to the tube 381 of the tubular shutter 38 through the engagement between the key projection 533*d* and the key groove 382*a*. As a result, the tube 381 is rotatable between an opening position where the aperture 381*a* communicates with the toner replenishment opening 332 and a closing position where the aperture 381*a* does not communicate with the toner replenishment opening 332.

Referring back to FIG. 3 again, the configuration of the intermediary device 60 is described.

The intermediary device 60 includes a substantially rectangular parallelepipedic housing 61 and a supporting member 62 on the upper surface of the housing 61. The supporting member 62 is configured to support the front ends of the respective toner cartridges 20.

The intermediary device 60 incorporates a plurality of intermediary ducts (not shown) through which the toner is supplied from the respective toner cartridges 20 to the corresponding developing devices 122, collection dusts (not shown) configured to guide the waste toner removed by the respective cleaning devices 127 for cleaning the respective photoconductive drums 121 and the cleaning device 128 for cleaning the intermediate transfer belt 125, and a collection container (not shown) configured to store the waste toner conveyed via the collection ducts.

The supporting member 62 includes supporting plates 621 as substantially wide as the width of the respective toner cartridges 20, partition walls 622 (five partition walls 622 are shown in FIG. 3) standing upward from the left and right edges of the supporting plates 621 and shutter mechanisms 623 arranged on the upper surfaces of the respective supporting plates 621. A support space V1 into which the front end of the corresponding toner cartridge 20 is inserted is formed between a pair of partition walls 622 adjacent to each other.

While the toner cartridge 20 is slidably pushed horizontally backward into the support space V1, a shutter plate (not shown) of the shutter mechanism 623 is opened by the toner cartridge 20. When the toner cartridge 20 is withdrawn forward, the shutter plate is returned to a closing position by a biasing member (not shown) connected with the shutter plate. The user may easily slide the toner cartridge 20 by holding the grip plate 512 because the base plate 514 and the grip plate 512 orthogonally extend to the sliding direction of the toner cartridge 20.

Figure 8:
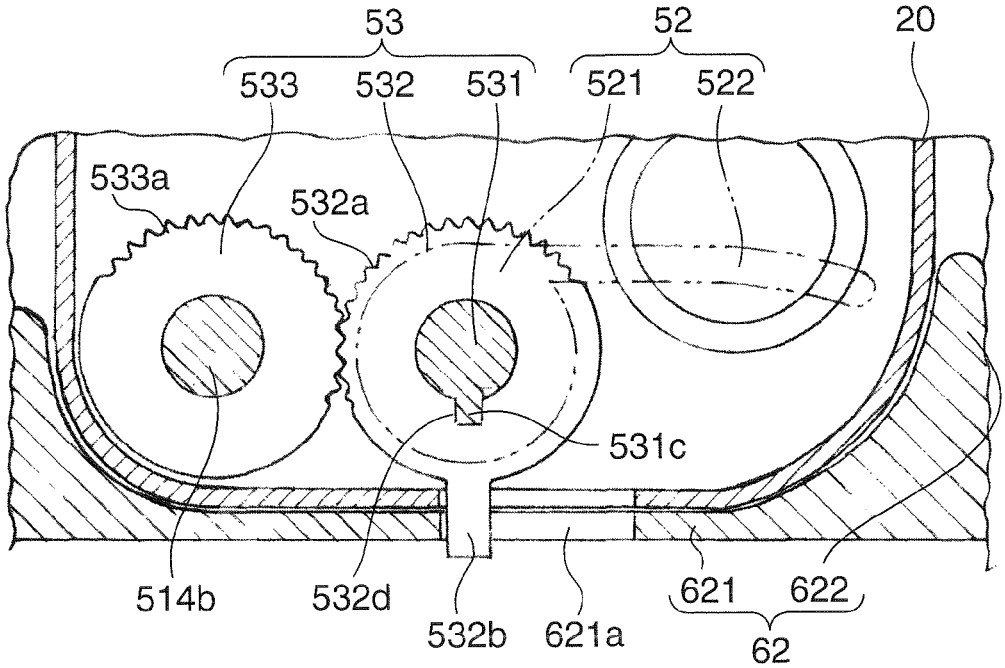
FIG. 8 is a sectional view for the toner cartridge and a supporting member of the intermediary device shown in FIG. 3.

FIG. 8 is a section of the supporting member 62 and the toner cartridge 20 including the lever 52 at the second position. Attachment of the toner cartridge 20 on the supporting member 62 is described with reference to FIGS. 3 and 7C as well as FIG. 8.

The supporting plate 621 includes a lock hole 621*a*. When the lever 62 is rotated by 90° clockwise from the first position, in which the stopper 532*b* horizontally projects as shown in FIG. 7C (when the lever 52 is rotated to the second position), the stopper 532*b* comes to project downward. The distal end of the downward projecting stopper 532*b* enters the lock hole 621*a*. Thus, the toner cartridge 20 comes to be locked into the supporting plate 621 so that the user may not withdraw the toner cartridge 20 from the housing 11 of the image forming apparatus 10. Thereafter, when the lever 52 is set to the first position in which the lever plate 522 vertically extends, the stopper 532*b* returns to the position shown in FIG. 7C so that the toner cartridge 20 is unlocked. At this time, the user may withdraw the toner cartridge 20 from the support space V1 because the stopper 532*b* is not engaged with the lock hole 621*a*.

Figure 9A:
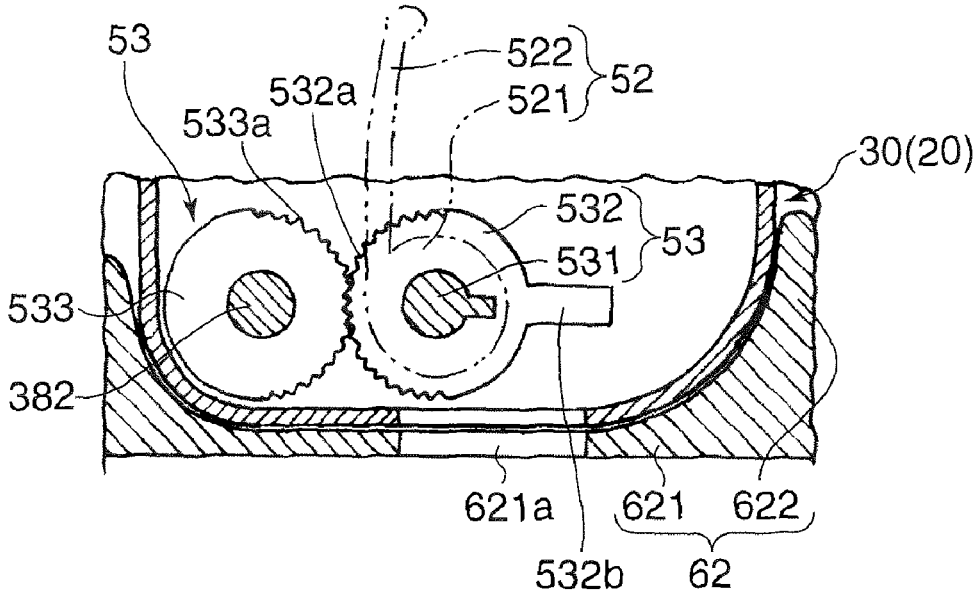
FIG. 9A is a sectional view for the toner cartridge and the supporting member of the intermediary device shown in FIG. 3, where a lever is located at a first position.
Figure 9B:
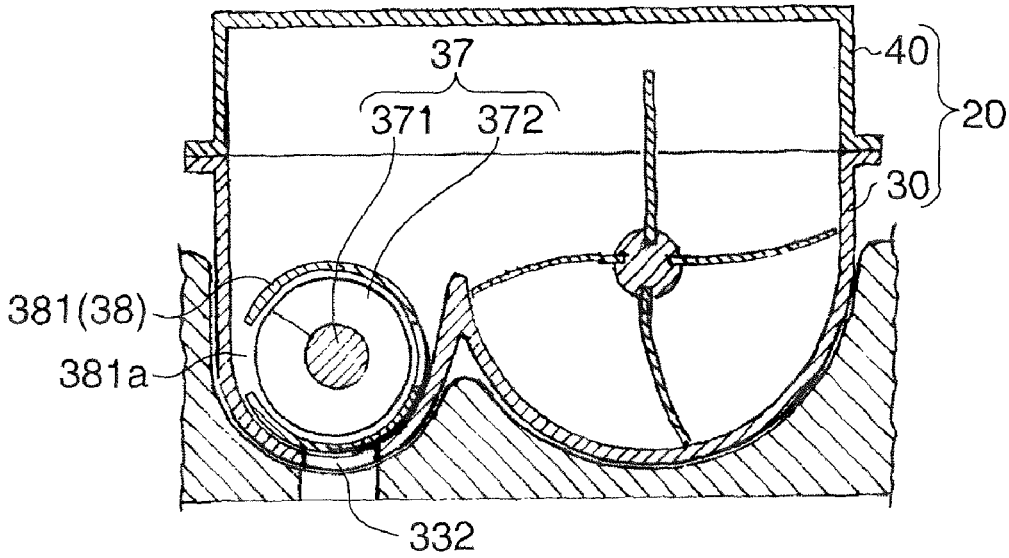
FIG. 9B is a sectional view for the toner cartridge and the supporting member of the intermediary device showing the position of an aperture of the shutter when the lever is at the first position.
Figure 10A:
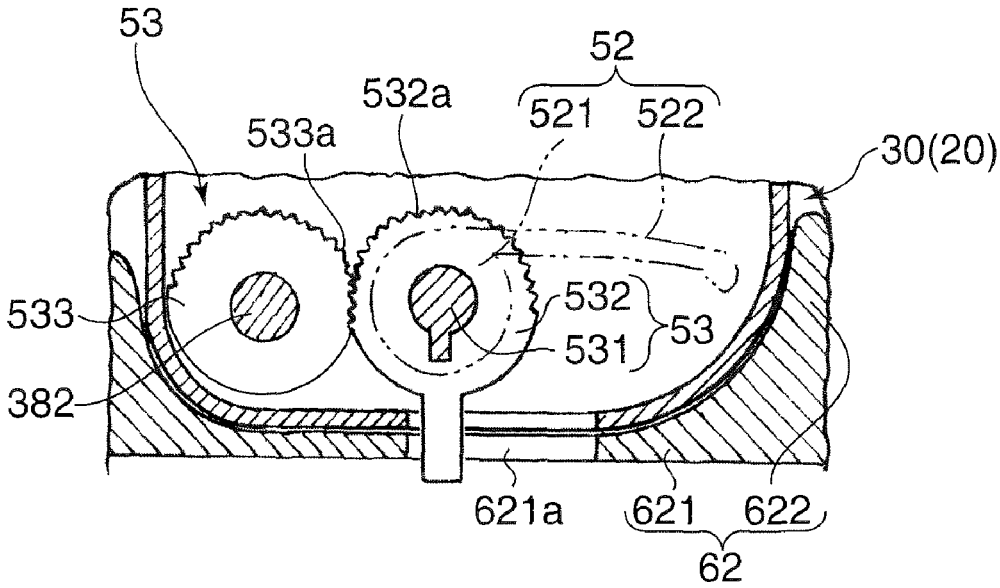
FIG. 10A is a sectional view for the toner cartridge and the supporting member of the intermediary device described in FIG. 3, where the lever is located at a second position.
Figure 10B:
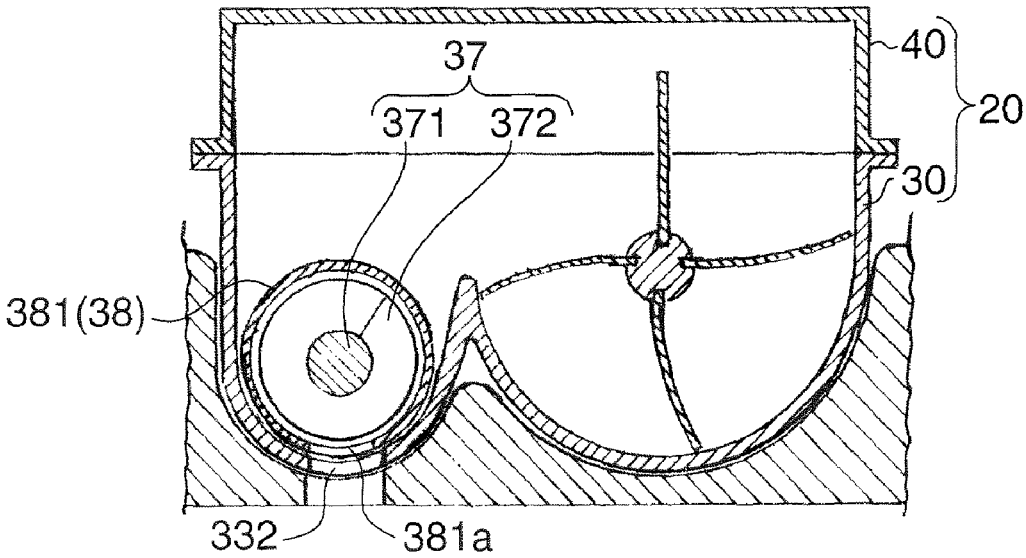
FIG. 10B is a sectional view for the toner cartridge and the supporting member of the intermediary device showing the position of the aperture of the shutter when the lever is at the second position.

FIG. 9A shows sections of the toner cartridge 20 including the lever 52 at the first position and the supporting member 62, and FIG. 9B shows sections of the toner cartridge 20 and the supporting member 62 as well as the position of the aperture 381*a* formed in the tube 381 of the tubular shutter 38 when the lever 52 is at the first position. FIG. 10A shows sections of the toner cartridge 20 including the lever 52 at the second position and the supporting member 62, and FIG. 10B shows sections of the toner cartridge 20 and the supporting member 62 as well as the position of the aperture 381*a* formed in the tube 381 of the tubular shutter 38 when the lever 52 is at the second position.

When the lever 52 is at the first position, the lever plate 522 vertically extends. At this time, the stopper 532*b* of the first sect gear 532 is disengaged from the lock hole 621*a* of the supporting plate 621 and extends rightward from the circumferential surface of the first sect gear 532. At this moment, the aperture 381*a* formed in the tube 381 of the tubular shutter 38 faces leftward so that the aperture 381*a* does not communicate with the toner replenishment opening 332. Thus, the toner in the toner cartridge 20 does not leak out from the toner cartridge 20.

When the lever 52 is at the second position, the lever plate 522 horizontally extends. At this time, the stopper 532*b* of the first sect gear 532 extends downward from the circumferential surface of the first sect gear 532 so as to be fitted into the lock hole 621*a* of the supporting plate 621. When the lever 52 is so rotated that the lever plate 522 horizontally extends, the second sect gear 533 engaged with the first sect gear 532 rotates by 90° counterclockwise about the shaft 382 of the tubular shutter 38. As a result, the aperture 381*a* formed in the tube 381 of the tubular shutter 38 integrally rotatable with the second sect gear 533 is faced downward to communicate with the toner replenishment opening 332. Further, the screw feeder 37 conveys the toner toward the toner replenishment opening 332. Accordingly, the toner in the toner cartridge 20 is replenished into the developing device 122 through the aperture 381*a* of the tubular shutter 38 and the toner replenishment opening 332 of the housing 30 as the screw feeder 37 rotates. The toner cartridge 20 may not be withdrawn from the housing 11 of the image forming apparatus 10 because the stopper 532*b* is fitted into the lock hole 621*a* of the supporting plate 621 at this time.

Figure 11:
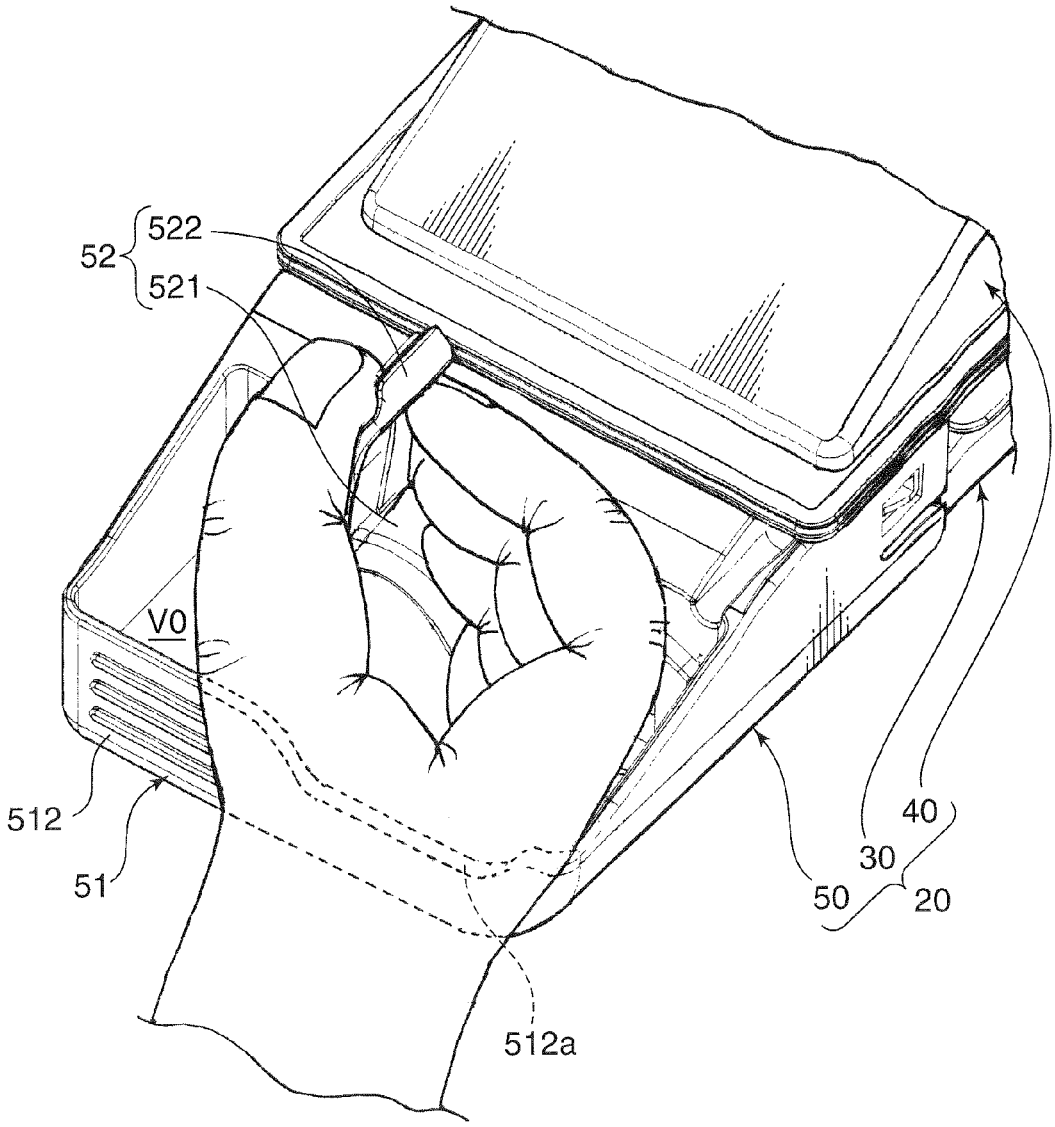
FIG. 11 is a perspective view showing the operation of the lever.

FIG. 11 shows the operation of the lever 52.

As described above, when the cover 50 is attached to the front end of the housing 30, the grip space V0 is formed by the bottom plate 511 of the cover 50, the grip plate 512 extending upward from the front edge of the bottom plate 511, the pair of side plates 513 extending upward from the left and right edges of the bottom plate 511 and the base plate 514 extending to face the grip plate 512. The user may access and operate the lever 52 by inserting her/his hand and/or fingers into the grip space V0. The bottom plate 511, the grip plate 512, the pair of the side plates 513 and the base plate 514 function to protect the user's hand and/or fingers, thereby preventing the user's hand and/or fingers from touching devices around the toner cartridge 20. The notch 512*a* is formed in the substantially right half of the upper edge of the grip plate 512. The downwardly recessed notch 512*a* facilitates the access of the user's right hand to the lever 52. As a result, the operability of the lever 52 may be enhanced.

Although the copier is shown as the image forming apparatus 10 incorporating the toner cartridges 20 in the above embodiment, the present invention is not limited thereto. A printer, a facsimile machine or any other apparatus configured to form an image on a sheet may be used as the image forming apparatus.

Although the photoconductive drums 121 and the intermediate transfer belt 125 are used as image bearing members in the above image forming apparatus 10, an image forming apparatus having a structure directly transferring images to a sheet from the photoconductive drums 121 without the intermediate transfer belt may be used.

Although the above image forming apparatus 10 is configured to perform color printing, the present invention is not limited thereto and an image forming apparatus configured to perform only single color printing may be used.

Although the above intermediary device 60 is used as a supporting portion for supporting the toner cartridges 20, the present invention is not limited thereto and the toner cartridges 20 may be supported by any frame disposed in the housing 11.

Although the grip space V0 is formed by the bottom plate 511, the base plate 514, the grip plate 512 and the pair of side plates 513 in the above toner cartridge 20, the present invention is not limited thereto and some of these plates may form the grip space V0. For example, the pair of side plates 513 may be omitted.

Although the lever 52 of the above toner cartridge 20 extends rightward in the second position, it may extend leftward. In this case, the notch 512*a* is preferably formed in a substantially left half of the upper edge of the grip plate 512.

Although the lever 52 of the above toner cartridge 20 is used to operate the tube 381 of the tubular shutter 38 and the stopper 532*b* of the first sect gear 532, the present invention is not limited thereto and the lever 52 may be used to operate either one of the tube 381 and the stopper 532*b*.

According to the above configuration, the lever configured to operate the toner cartridge is partially covered by the cover. Thus, the lever is protected from external forces and the user accessing the lever through the uncovering area is protected by the cover. Therefore, the toner cartridge configured to replenish the toner may be safely mounted in the image forming apparatus for forming a toner image on a sheet. Further, the lever is protected from external forces by the cover.

This application claims priority to Japanese Patent Application Serial Number 2008-328740, filed on Dec. 24, 2008 and Japanese Patent Application Serial Number 2009-269711, filed on Nov. 27, 2009 by at least one common inventor, and which is incorporated herein by reference in its entirety.

As this invention may be embodied in several forms without departing from the spirit of essential characteristics thereof, the present embodiment is therefore illustrative and not restrictive, since the scope of the invention is formed by the appended claims rather than by the description preceding them, and all changes that fall within metes and bounds of the claims, or equivalence of such metes and bounds are therefore intended to be embraced by the claims.

What is claimed is:

1. A toner cartridge configured to contain toner, comprising:

a housing configured to contain the toner;

a lever configured to operate the toner cartridge; and a cover including a base plate situated between the lever and the housing so that the base plate supports the lever, a grip plate arranged to face the base plate and at least one side plate extending between lateral edges of the base plate and the grip plate so that the base plate, the grip plate and the side plate partially surround the lever;

wherein:

upper edges of the base plate, the grip plate and the side plate of the cover form an uncovering area where the lever is not covered so that the lever is accessible through the uncovering area.

2. The toner cartridge according to claim 1 further comprising a stopper connected with the lever, the stopper configured to lock the toner cartridge;

wherein the lever is configured to be rotatable between a first position where the stopper does not lock the toner cartridge and a second position where the stopper locks the toner cartridge.

3. The toner cartridge according to claim 2, wherein the cover includes a bottom plate extending along the lever at the second position.

4. The toner cartridge according to claim 1, further comprising:

a toner replenishment opening; and a shutter configured to open and close the toner replenishment opening, the shutter connected with the lever;

wherein the lever is configured to be rotatable between a first position where the shutter closes the toner replenishment opening and a second position where the shutter opens the toner replenishment opening.

5. The toner cartridge according to claim 4, wherein the side plate extends along the lever at the first position.

6. The toner cartridge according to claim 1, further comprising a rotating mechanism arranged between the base plate and the housing so that the rotating mechanism couples the lever to the shutter, wherein the base plate partitions the rotating mechanism from the lever.

7. The toner cartridge according to claim 2, wherein the side plate extends along the lever at the first position.

8. The toner cartridge according to claim 1, wherein the at least one side plate includes:

a pair of side plates extending between both lateral edges of the base plate and the grip plate, and wherein the cover further includes:

a bottom plate configured to close an area surrounded with the base plate, the grip plate and the pair of side plates.

9. The toner cartridge according to claim 1, wherein the cover is formed with a notch for enlarging the uncovering area.

10. A toner cartridge, comprising:

a housing configured to contain toner inside and including at least one side wall extending in a direction orthogonal to a sliding direction of the toner cartridge;

a cover attached to the side wall of the housing; and a lever rotatably attached to the cover so that the lever is exposed outside, wherein:

the cover includes:

a base plate rotatably holding the lever and engaged with the side wall, a grip plate distanced from the base plate at a side opposite to the housing and arranged to face the base plate, and at least one side plate extending between lateral edges of the base plate and the grip plate, the base plate, the grip plate and the side plate partially surrounding the lever to form a grip space in which the lever is stored and operated so that fingers are inserted into the grip space from above.

11. An image forming apparatus configured to form a toner image on a sheet, comprising:

an image forming unit configured to form the toner image on the sheet; and a toner cartridge for replenishing toner into the image forming unit, wherein:

the toner cartridge includes a housing configured to contain the toner, a lever configured to operate the toner cartridge and a cover including a base plate between the lever and the housing so that the base plate supports the lever, a grip plate facing the base plate and at least one side plate extending between lateral edges of the base plate and the grip plate, the base plate, the grip plate and the side plate partially surrounding the lever, upper edges of the base plate, the grip plate and the side plate forming an uncovering area where the lever is not covered so that the lever is accessible through the uncovering area.

12. The image forming apparatus according to claim 11, wherein:

the toner cartridge is slidably mounted into and detached from the image forming apparatus, and the base plate and the grip plate are arranged to cross a sliding direction of the toner cartridge to be mounted into and detached from the image forming apparatus.

* * * * *